United States Patent [19]

Bucher et al.

[11] 4,289,548

[45] Sep. 15, 1981

[54] HIGH STRENGTH COLD FINISHED BARS

[75] Inventors: John H. Bucher; John F. Butler, both of Bethel Park; John F. Held, Verona, all of Pa.

[73] Assignee: Jones & Laughlin Steel Corporation, Pittsburgh, Pa.

[21] Appl. No.: 826,014

[22] Filed: Aug. 19, 1977

[51] Int. Cl.[3] ..... C21D 9/52

[52] U.S. Cl. ..... 148/12 B; 148/12 F; 148/36

[58] Field of Search ..... 148/12 B, 12 F, 36

[56] References Cited

U.S. PATENT DOCUMENTS

| | | | |
|---|---|---|---|
| 2,933,424 | 4/1960 | Canney et al. | 148/12 B |
| 3,674,570 | 7/1972 | Hallstrom et al. | 148/12 B |
| 3,904,445 | 9/1975 | Gallagher, Jr. | 148/12 B |
| 4,046,600 | 9/1977 | Yamakoshi et al. | 148/12 B |

*Primary Examiner*—W. Stallard

*Attorney, Agent, or Firm*—John Stelmah

[57] ABSTRACT

High strength, cold finished steel bars strengthened through the addition of from 0.05% to 0.15% vanadium and 0.001% to 0.025% nitrogen are produced by a series of steps involving hot rolling, cold drawing, and heat-treatment.

11 Claims, 4 Drawing Figures

HIGH STRENGTH COLD FINISHED BARS

The invention pertains to the production of high strength bar products in the cold finished or cold finished and heat-treated metallurgical condition. Such products are produced from families of killed steels composed of either 0.30% to 0.65% carbon, 0.30% to 1.65% maximum manganese, 0.01% to 0.35% silicon, 0.01% maximum aluminum, 0.05% to 0.15% vanadium, 0.001% to 0.025% nitrogen, balance iron (Type I) or 0.30% to 0.65% carbon, 0.30% to 1.65% manganese, 0.01% to 0.35% silicon, 0.01% maximum aluminum, 0.05% to 0.15% vanadium, 0.001% to 0.025% nitrogen, up to 3.0% nickel, up to 1.5% chromium, and up to 0.5% molybdenum, balance iron (Type II). The Type I steels are cold drawn directly from the hot rolled bar state while the Type II steels require annealing of the hot rolled bar prior to cold drawing. Following cold drawing, either of the above mentioned cold drawn steels may optionally be heat-treated for the purpose of either softening or hardening the bars.

While certain patents relate to the production of vanadium-containing bar products, none is believed to involve the same concept underlying the invention. For example, U.S. Pat. Nos. 3,068,095 and 3,328,211 and British Pat. No. 1,001,233 pertain to vanadium-containing hot rolled bars. In addition, U.S. Pat. No. 2,767,837 relates to the elevated temperature drawing of hot rolled bars that may contain vanadium. This invention, however, relates to the production of high strength bar products by cold drawing. Cold drawing comprises the drawing of a descaled bar of hot rolled steel through a die by means of power drawing equipment to the desired shape. For purposes of this invention, cold drawing and elevated temperature drawing may be distinguished as follows in accordance with the definitions contained in U.S. Pat. No. 2,998,336. The term "cold drawing" means the taking of a reduction in a cross-section of the steel bar at about ambient temperature. It will be understood that this includes advancement of the steel through a die to effect reduction in cross-sectional area at a temperature slightly above ambient temperature on up to about 200° F.

The term "elevated temperature drawing" means the taking of a reduction in the cross-section of the steel by advancement of the steel through a die while at a temperature within the range of 250° F. to the lower critical temperature for the steel composition, i.e. on the order of 1100°-1400° F.

In addition, U.S. Pat. Nos. 2,313,584, 2,400,866, 3,668,020, 3,844,848, and 3,926,687 pertain to vanadium-containing steels that are manufactured into wire products. However, unlike the cold drawn bars of this invention, the manufacture of wire products involves very high or drastic reductions in area, complex and specialized heat-treatments such as patenting, and generally smaller sized products.

The traditional approach to producing relatively high strength cold finished bars has been to use relatively heavy drafting, i.e., the steel bars are cold drawn using reductions in areas in excess of that required for dimensional uniformity and surface quality. Heavy drafting, however, involves certain undesirable characteristics related to mill processing such as the need for machine pointing rather than push pointing prior to cold drawing, an increased tendency for strain cracking during or following cold drawing because of the high reductions in area required to obtain the required high strength, the lack of drawing equipment with sufficient power to achieve high reductions in area, and the use of special, costly dies for the needed reductions in area. Furthermore, heavy drafting involves limitations upon material properties that can be developed such as strength because of limitations as to the amount of cold drawing that can be imparted to the material. Also stress relief treatments are oftentimes limited as to the temperatures that can be utilized following cold drawing because of the possibility of strength loss. The steels of this invention may be stress relieved at relatively higher temperatures due to the fact that this invention involves the use of micro-alloying additions which increase the strength of the hot rolled bars to the extent that relatively light drafts or reductions in area can be used during cold drawing to obtain the requisite strength level. Thus, the relief of residual stresses and consequent improved product uniformity is obtainable.

Thus objectives of the invention include providing a process for producing high strength cold finished bars of the Type I and Type II compositions listed above that does not require the elevated temperature drawing or the heavy drafting and consequent problems of the prior art.

These and other objectives and advantages of the invention will become more apparent to those skilled in the art from the following description of the invention.

It has been discovered that two general classes of steel compositions may be processed into several types of products in accordance with various process embodiments of the invention to achieve the desired product.

The first class of steel (Type I) comprises about 0.30% to 0.65% carbon, about 0.30% to 1.65% manganese, about 0.01% to 0.35% silicon, about 0.01% maximum aluminum, about 0.05% to 0.15% vanadium, about 0.001% to 0.025% nitrogen, balance essentially iron.

The second class of steel (Type II) comprises the same components as the Type I composition with other alloying elements such as up to 3.0% nickel, up to 1.5% chromium, and up to 0.5% molybdenum, either singly or in combination thereof.

The carbon range for both classes of steel should range from about 0.30% to 0.65%. The lower limit is required to ensure attainment of a minimum yield strength of 100 k.s.i. while the upper limit was selected with an aim toward preventing the deterioration of mechanical properties such as ductility, toughness and weldability. An upper limit of 0.55% carbon is preferred for the purpose of further optimizing the above stated properties.

Manganese is desirably maintained on the order of from 0.30% to 1.65% so as to promote desirable hot working characteristics and hardenability. A manganese content of from 1.35% to 1.65% is preferred when producing resulfurized steel due to hot workability considerations.

Silicon is included in amounts from 0.01% to 0.35%. This element is used to kill the steel rather than aluminum. Aluminum is restricted to 0.01% maximum because aluminum combines with nitrogen more readily than vanadium and thus amounts greater than about 0.01% would hinder the formation of desirable vanadium nitrides.

Figure 1:
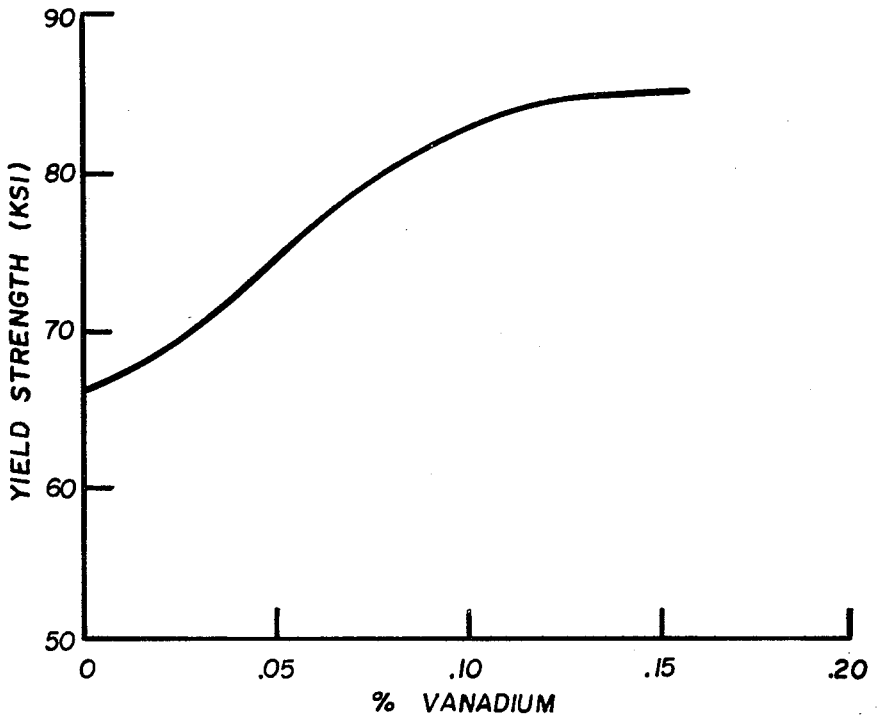
FIG. 1 depicts the influence of vanadium content upon strength for hot rolled bars.

Vanadium should be included in amounts ranging between about 0.05% to 0.15% for purposes of contributing to grain refinement and strengthening due to the combination of vanadium with the interstitial elements carbon and nitrogen. FIG. 1 illustrates the effect of vanadium upon yield strength for hot rolled bars of standard AISI 1050 steels containing various amounts of vanadium and residual nitrogen. As may be seen the lower limit is needed to attain about a 70 k.s.i. yield strength and no appreciable incremental strengthening occurs at vanadium levels above about 0.15%. The strengthening effect of vanadium is independent from the strengthening contributions of carbon and other alloying elements such as manganese, nickel, chromium, and molybdenum. Abrasion or wear resistance is also improved through formation of relatively hard particles of vanadium carbides and vanadium carbonitrides.

A preferred lower vanadium limit is 0.07% so as to increase hot rolled strength to about 80 k.s.i. and thereby be able to utilize lesser reductions in area during subsequent cold drawing.

Figure 2:
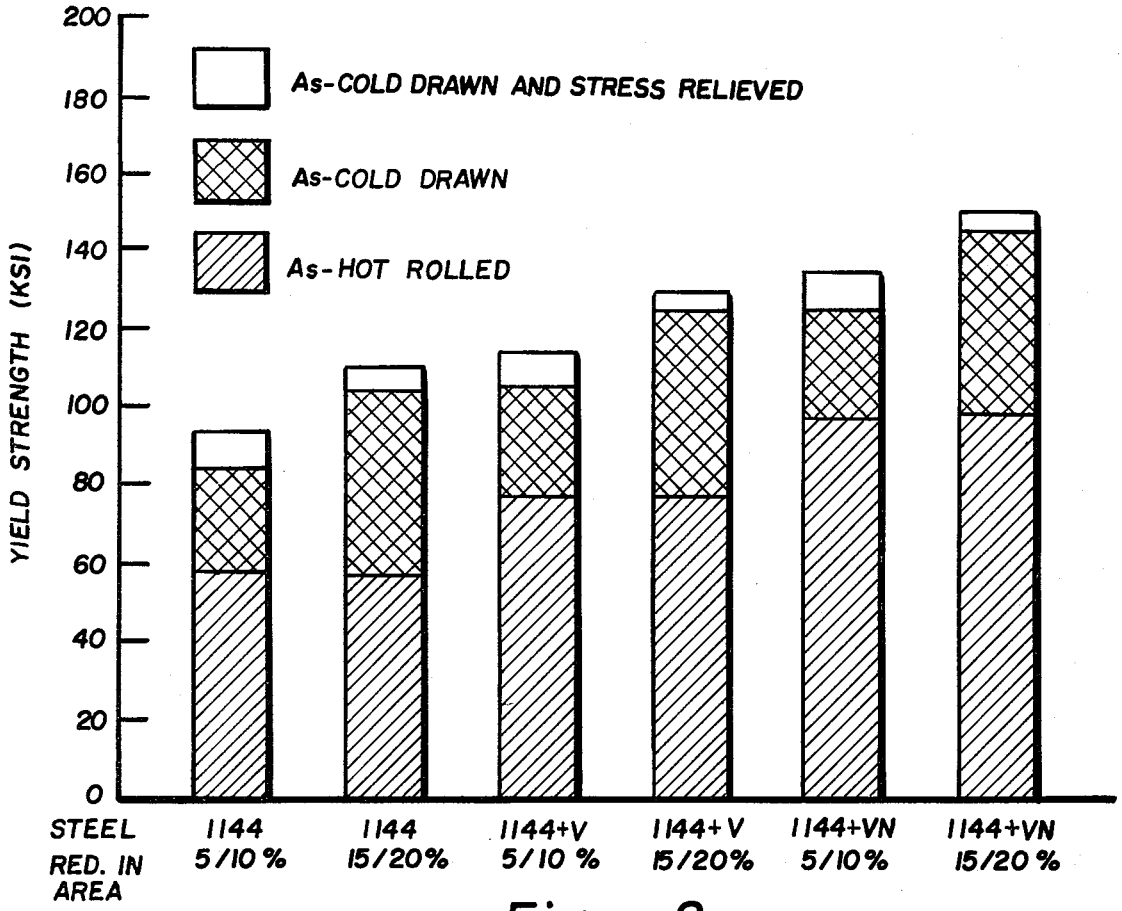
FIG. 2 is a graphical representation of the strength levels obtainable with two steel compositions of the invention and a standard, commercially available 1144 steel composition following hot rolling and various amounts of cold work.

Nitrogen is present in amounts ranging from about 0.001% to 0.025%. Typical residual nitrogen contents are from 0.001% to 0.007% with higher amounts requiring renitrogenizing during steelmaking. As the nitrogen content increases a larger amount of vanadium nitrides are formed and the strengthening effect is increased. Sufficient vanadium is present so that the strengthening phenomena does not abate at higher nitrogen levels. FIG. 2 graphically illustrates the effect of varying amounts of cold work for a standard AISI 1144 steel having various vanadium and nitrogen contents. The designation "+V" indicates vanadium being present between 0.05% and 0.15% and nitrogen in residual (0.001% to 0.007%) quantities while the designation "+VN" indicates that the steel includes vanadium between 0.05% and 0.15% and nitrogen between 0.007% and 0.025%. The figure serves to illustrate the influence of the various variables in the hot rolled, cold drawn, and cold drawn and stress relieved conditions.

The inventive steels may also be resulfurized or leaded for the purpose of machinability improvement. Resulfurized steels involve sulfur contents on the order of 0.07% to 0.4% in contrast to normal commercial limits of 0.05% maximum. Leaded steels involve lead contents on the order of 0.15% to 0.35%. In addition, additions of selenium and tellurium in amounts sufficient to enhance machinability are within the scope of the invention.

In addition to the above described compositional limits for Type I and II steels, the Type II steels contain other alloying elements such as up to 3.0% nickel, up to 1.5% chromium, and up to 0.5% molybdenum; either singly or in combination thereof. Such elements are added in amounts to achieve known benefits such as to improve toughness, hardenability, and corrosion resistance. These elements also function to increase the strength of the hot rolled bar product to an extent that yield strengths in excess of 100 k.s.i. are obtained, thereby requiring an annealing treatment prior to cold drawing.

Steels of the Type I and Type II classes are manufactured through use of conventional steelmaking techniques and then processed into billet form by continuous casting or by ingot casting and hot rolling. The resultant billet is then hot rolled to bar form in a conventional manner.

Control of the strength of the hot rolled bar can be varied easily by control of the vanadium and nitrogen micro-alloying additions. This control of hot rolled strength increases the versatility of products which can be developed by the use of various cold reductions. Therefore, specific products are now obtainable which previously could not be achieved when the use of cold drafting alone was available to develop the desired strengths. Moreover, the potent effect of these micro-alloying elements is such that the desired strength levels can be achieved much more economically than the use of traditional alloying elements such as nickel and chromium or the extremely difficult practice of combining heavy deformation with elevated temperature drawing such as has been traditionally used for prior products. This approach is particularly amenable to the use of strand cast products. The close compositional control achievable with strand casting in combination with the micro-alloying approach provides a product with improved consistency with expected benefits in machinability and uniformity of mechanical properties.

Following hot rolling, the Type I steels have a yield strength of about 70 to 100 k.s.i. primarily due to their chemical composition. A maximum yield strength level of 100 k.s.i. is preferred so as to minimize subsequent problems in cold drawing. On the other hand, the Type II steels, due to their higher alloy content, have a hot rolled yield strength in excess of 100 k.s.i. and typically on the order of 140 k.s.i. While the Type I bars are directly cold drawn from the hot rolled metallurgical condition, the higher yield strength of the Type II bars requires the use of an annealing treatment to soften the bars prior to cold drawing. An annealing treatment involving heating to about 1150° F. to 1300° F. for about 5 to 20 hours will result in lowering the yield strength to about 90 to 115 k.s.i.

The hot rolled Type I steel bars and the hot rolled and annealed Type II steel bars are then descaled and cold drawn to effect from 4% to 25% reduction in area. The minimum reduction in area is required for sizing and surface finish purposes while higher reductions are required for producing higher strength levels. Typical reductions are on the order of from 10% to 15%. Light drafts are considered to be on the order of from 4% to 10% and heavy drafts on the order of 15% to 25%.

Figure 3:
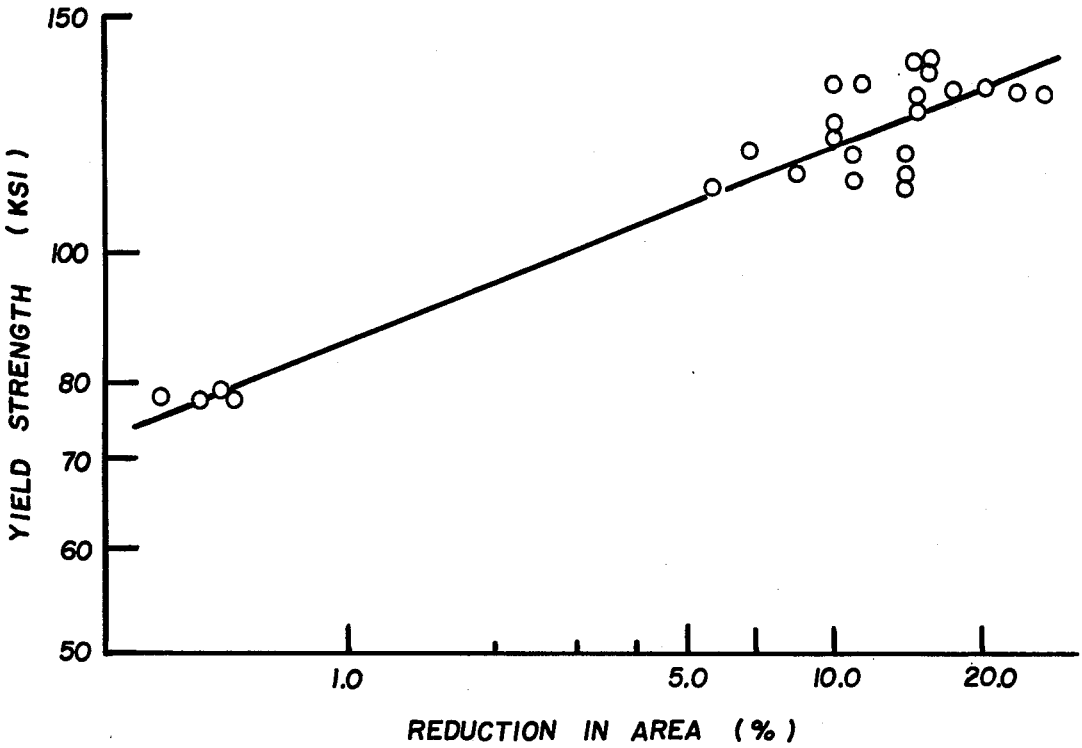
FIG. 3 is a plot of yield strength vs. % reduction in area for vanadium containing and vanadium plus nitrogen containing cold drawn bars.

FIG. 3 is a curve illustrating the general effect of cold work (% reduction in area) upon yield strength for hot rolled AISI 1144 steel bars containing from 0.05% to 0.15% vanadium and 0.001% to 0.007% nitrogen. Similar relationships can be easily developed for other types of steel within the scope of the invention.

Figure 4:
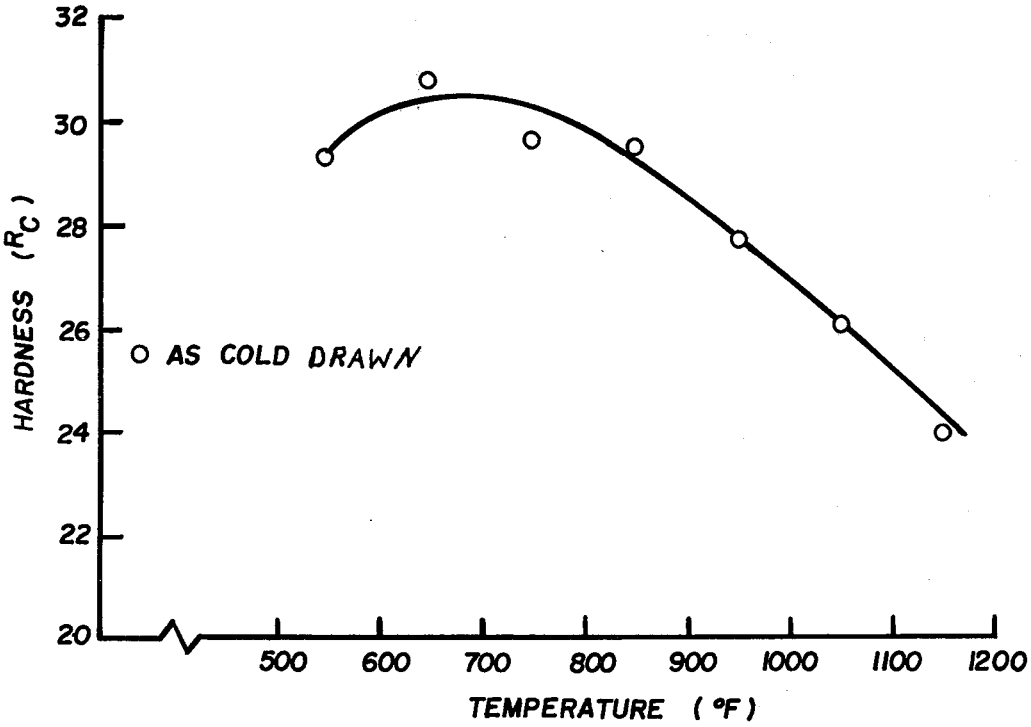
FIG. 4 is a plot depicting the response to temperature for cold drawn bars heated to various temperatures.

Following cold drawing, Type I and Type II bars may be optionally heat treated by heating to a temperature between about 550° F. and 1150° F. for on the order of several hours. FIG. 4 is a plot of the response to heat treatment of an AISI 1144 steel in the cold drawn condition (13.9% reduction in area) that was heated to various temperatures for several hours. As may be observed, it is possible to either harden or soften the material at various temperatures. The hardening phenomena is believed to be related to aging in which free carbon and nitrogen are precipitated from solution onto dislocations developed during the cold drawing step.

TABLE I

EFFECT OF HEAT TREATMENT TEMPERATURE ON TENSILE PROPERTIES GRADE 1144+VN, DRAWN 13.9%

| | Cold Drawn Condition | 550° F. | 650° F. | 750° F. | 850° F. | 950° F. | 1050° F. | 1150° F. |
|---|---|---|---|---|---|---|---|---|
| Yield Strength (KSI) | 131.0 | 146.5 | 140.0 | 134.8 | 128.5 | 120.7 | 117.0 | 111.0 |
| Tensile Strength (KSI) | 145.0 | 154.0 | 151.0 | 147.5 | 143.8 | 140.5 | 136.3 | 130.5 |
| % Elongation in 2" | 8.0 | 7.5 | 9.5 | 10.0 | 11.2 | 12.0 | 13.7 | 16.2 |
| % Reduction in Area | 31.0 | 28.3 | 29.3 | 31.2 | 31.9 | 33.2 | 36.4 | 40.2 |

TABLE II

COMPOSITION OF HIGH STRENGTH STEELS

| Example | C | Mn | P | S | Si | V | $N_2$ | Cr | Mo | Pb |
|---|---|---|---|---|---|---|---|---|---|---|
| 1 | .44 | 1.40 | .027 | .34 | .02 | .10 | .003 | — | — | — |
| 2 | .47 | 1.60 | .024 | .35 | .02 | .11 | .012 | — | — | — |
| 3 | .51 | .73 | .014 | .018 | .23 | .14 | .019 | — | — | .21 |
| 4 | .53 | .89 | .016 | .017 | .21 | .16 | .018 | — | — | — |
| 5 | .38 | .90 | .010 | .09 | .34 | .10 | .003 | 1.00 | .23 | — |
| 6 | .42 | .91 | .010 | .10 | .34 | .11 | .025 | 1.05 | .23 | — |

TABLE III

PROCESSING OF HIGH STRENGTH STEELS

| Example | Annealing Treatment | % Cold Reduction | Heat Treating Temperature, °F. |
|---|---|---|---|
| 1 | None | 13.0 | 650 |
| 1A | None | 20.9 | 650 |
| 2 | None | 13.9 | 650 |
| 2A | None | 20.9 | 650 |
| 3 | None | 21.8 | 550 |
| 4 | None | 18.8 | — |
| 5 | 10 hours at 1170° F. | 11.0 | 1100 |
| 6 | 10 hours at 1170° F. | 16.0 | 1100 |
| 6A | 10 hours at 1170° F. | 16.0 | — |

On the other hand, softening is believed to be the result of the relief of residual stresses caused by cold drawing. Table I indicates the various tensile properties prior to and following the various heat-treatments of the steel of FIG. 4.

As examples of the influence of processing and compositional parameters upon product properties, the six steels listed in Table II were processed in accordance with the schedule set forth in Table III. Note that steels 1, 2, and 6 were processed according to two different schedules. The resultant properties are listed in Table IV.

TABLE IV

MECHANICAL PROPERTIES OF HIGH STRENGTH STEELS

| Material | Yield Strength (KSI) | Ultimate Tensile Strength (KSI) | Uniform Elongation (% in 2") | Total Elongation (% in 2") | % R.A. | Hardness $R_c$ |
|---|---|---|---|---|---|---|
| 1 | 126 | 139 | 5.5 | 10.0 | 31.9 | 26.9 |
| 1A | 134 | 144 | 5.5 | 9.5 | 30.0 | 28.0 |
| 2 | 140 | 151 | 4.0 | 9.5 | 29.3 | 30.8 |
| 2A | 152 | 159 | 5.5 | 8.4 | 27.7 | 32.5 |
| 3 | 130 | 145 | 5.8 | 11.0 | 27.5 | 27.0 |
| 4 | 141 | 154 | 2.0 | 7.5 | 16.4 | 27.5 |
| 5 | 122 | 136 | 8.5 | 15.5 | 48.5 | 28.6 |
| 6 | 134 | 145 | 7.5 | 14.0 | 45.8 | 31.0 |
| 6A | 137 | 150 | 2.0 | 12.0 | 43.0 | 33.0 |

Based upon the principles described earlier, it has been determined that products having minimum yield strengths of 100 k.s.i., 125 k.s.i., and 150 k.s.i. can be produced in several fashions.

Cold drawn bars of the Type I chemical composition having a minimum yield strength of 100 k.s.i., a minimum total elongation of about 10%, and a minimum reduction area of about 25% require a cold reduction in area from the hot rolled metallurgical condition of from 4% to 25%. A minimum yield strength of 125 k.s.i., a minimum total elongation of 5%, and a minimum reduction in area of 15% can be obtained for Type I compositions through either restricting vanadium to 0.07% to 0.15% and nitrogen to 0.008% to 0.025% or through restricting the amount of cold reduction from 15% to 25%. In addition, Type I compositions can be produced in cold drawn bar form with a minimum yield strength of 150 k.s.i., a minimum total elongation of 5%, and a minimum reduction in area of 15% by restricting carbon to 0.45% to 0.65%, vanadium to 0.07% to 0.15%, nitrogen to 0.008% to 0.025%, and the amount of cold reduction in area to 20% to 25%.

Cold drawn bars of the Type II chemical composition having a minimum yield strength of 125 k.s.i., a minimum total elongation of 10%, and a minimum reduction in area of 35% require a cold reduction in area from the hot rolled metallurgical condition of from 4% to 25%. A minimum yield strength of 150 k.s.i., a minimum total elongation of 5%, and a minimum reduction in area of 10% can be obtained for Type II compositions through restricting vanadium to 0.07% to 0.15%, nitrogen to 0.008% to 0.025% and restricting the amount of cold reduction from 15% to 25%.

We claim:

1. A method for producing a high strength, cold finished steel bar, comprising:

a. hot rolling a killed steel consisting essentially of 0.30% to 0.65% carbon, 0.30% to 1.65% manganese, 0.05% maximum sulfur, 0.01% to 0.35% silicon, 0.01% maximum aluminum, 0.07% to 0.15% vanadium, 0.008% to 0.025% nitrogen, balance iron, to form a bar having a yield strength between about 70 and 100 k.s.i.; and b. cold drawing said bar to effect from 4% to 25% reduction in its area and thereby obtain a minimum yield strength 125 k.s.i., a minimum total elongation of 5%, a minimum reduction in area of 15%, good toughness, and good abrasion resistance.

2. A method for producing a high strength, cold finished steel bar, comprising:

a. hot rolling a killed steel consisting essentially of 0.45% to 0.65% carbon, 0.30% to 1.65% manganese, 0.05% maximum sulfur, 0.01% to 0.35% silicon, 0.01% maximum aluminum, 0.07% to 0.15% vanadium, 0.008% to 0.025% nitrogen, balance iron, to form a bar having a yield strength between about 70 and 100 k.s.i.; and b. cold drawing said bar to effect from 20% to 25% reduction in its area and thereby obtain a minimum yield strength 150 k.s.i., a minimum total elongation of 5%, a minimum reduction in area of 15%, good toughness, and good abrasion resistance.

3. A method for producing a high strength, cold finished steel bar, comprising:

a. hot rolling a killed steel consisting essentially of 0.30% to 0.65% carbon, 0.30% to 1.65% manganese, 0.05% maximum sulfur, 0.01% to 0.35% silicon, 0.01% maximum aluminum, 0.05% to 0.15% vanadium, 0.001% to 0.025% nitrogen, up to 3.0% nickel, up to 1.5% chromium, up to 0.5% molybdenum, balance iron, to form a bar having a yield strength in excess of about 100 k.s.i.;

b. annealing said hot rolled bar for 5 to 20 hours at a temperature between about 1150° F. to 1350° F. to lower the yield strength to between about 90 k.s.i. and 115 k.s.i.; and c. cold drawing said bar to effect from 4% to 25% reduction in its area and thereby obtain a minimum yield strength of 125 k.s.i., a minimum total elongation of 10%, a minimum reduction in area of 35%, good toughness, and good abrasion resistance.

4. The method of claim 3, wherein:

said steel further consists essentially of 0.15 to 0.35% lead.

5. The method of claim 3 which further includes:

heat treating said cold drawn bar by heating to between about 550° F. to 1150° F. for at least several hours.

6. The method of claim 3, wherein:

said bar is cold drawn from 10% to 15%.

7. A method for producing a high strength, cold finished steel bar, comprising:

a. hot rolling a killed steel consisting essentially of 0.30% to 0.65% carbon, 1.35% to 1.65% manganese, 0.07% to 0.4% sulfur, 0.01% to 0.35% silicon, 0.01% maximum aluminum, 0.05% to 0.15% vanadium, 0.001% to 0.025% nitrogen, up to 3.0% nickel, up to 1.5% chromium, up to 0.5% molybdenum, balance iron, to form a bar having a yield strength in excess of about 100 k.s.i.;

b. annealing said hot rolled bar for 5 to 20 hours at a temperature between about 1150° F. to 1350° F. to lower the yield strength to between about 90 k.s.i. and 115 k.s.i.; and c. cold drawing said bar to effect from 4% to 25% reduction in its area and thereby obtain a minimum yield strength of 125 k.s.i., a minimum total elongation of 10%, a minimum reduction in area of 35%, good toughness, and good abrasion resistance.

8. A method for producing a high strength, cold finished steel bar, comprising:

a. hot rolling a killed steel consisting essentially of 0.30% to 0.65% carbon, 0.30% to 1.65% manganese, 0.05% maximum sulfur, 0.01% to 0.35% silicon, 0.01% maximum aluminum, 0.07% to 0.15% vanadium, 0.008% to 0.025% nitrogen, up to 3.0% nickel, up to 1.5% chromium, up to 0.5% molybdenum, balance iron, to form a bar having a yield strength in excess of about 100 k.s.i.;

b. annealing said hot rolled bar for 5 to 20 hours at a temperature between about 1150° F. to 1350° F. to lower the yield strength to between about 90 k.s.i. and 115 k.s.i.; and c. cold drawing said bar to effect from 15% to 25% reduction in its area and thereby obtain a minimum yield strength of 150 k.s.i., a minimum total elongation of 5%, a minimum reduction in area of 10%, good toughness, and good abrasion resistance.

9. A high strength steel bar in the cold drawn metallurgical condition consisting essentially of 0.30% to 0.65% carbon, 0.30% to 1.65% manganese, 0.05% maximum sulfur, 0.01% to 0.35% silicon, 0.01% maximum aluminum, 0.07% to 0.15% vanadium, 0.008% to 0.025% nitrogen, balance iron; said steel bar having a minimum yield strength of 125 k.s.i., a minimum total elongation of 5%, a minimum reduction in area of 15%, good toughness, and good abrasion resistance.

10. The high strength steel bar of claim 9, wherein:

said carbon content is from 0.45% to 0.65% and said minimum yield strength is 150 k.s.i.

11. A high strength steel bar in the cold drawn metallurgical condition consisting essentially of 0.30% to 0.65% carbon, 0.30% to 1.65% manganese, 0.05% maximum sulfur, 0.01% to 0.35% silicon, 0.01% maximum aluminum, 0.07% to 0.15% vanadium, 0.008% to 0.025% nitrogen, up to 3.0% nickel, up to 1.5% chromium, up to 0.5% molybdenum, balance iron, said steel bar having a minimum yield strength of 150 k.s.i., a minimum total elongation of 5%, a minimum reduction in area of 10%, good toughness, and good abrasion resistance.

* * * * *